United States Patent [19]

Hicks

[11] Patent Number: 4,791,764

[45] Date of Patent: Dec. 20, 1988

[54] STAIR TREAD SUPPORT

[76] Inventor: Dwain Hicks, 1251 Third St., S.W., New Philadelphia, Tuscarawas County, Ohio 44622

[21] Appl. No.: 96,619

[22] Filed: Sep. 14, 1987

[51] Int. Cl.[4] ..... E04F 11/00

[52] U.S. Cl. ..... 52/187

[58] Field of Search ..... 52/184, 187; 248/243

[56] References Cited

U.S. PATENT DOCUMENTS

| | | | |
|---|---|---|---|
| 485,449 | 11/1892 | Boreman | 52/187 |
| 595,064 | 12/1897 | Herbst | 248/243 |
| 768,295 | 8/1904 | Palfrey | 248/243 |
| 977,609 | 12/1910 | Freeman | 248/243 |
| 1,216,214 | 2/1917 | Connell | 248/238 |
| 1,361,918 | 12/1920 | Smith | 52/187 |
| 2,622,834 | 12/1952 | Sparring | 248/243 |
| 3,349,414 | 10/1967 | Gutner | 248/243 |

*Primary Examiner*—John E. Murtagh
*Attorney, Agent, or Firm*—Frease & Bishop

[57] ABSTRACT

A spiral staircase having a central wooden center column which includes slots spirally located around the center column. Each of the slots includes a steel support bracket which consists of a base plate and a pair of support arms extending from the base plate. Each of the support arms includes a pair of support pins extending from opposite faces of the support arms. Each of the stair treads and risers are provided with a steel pin engaging hook assembly which is attached to the inner end of the tread riser. The engaging member is provided with four downwardly disposed hook members each of which engages one of the pins mounted on the support arms. The stair treads and risers are supported in cantilever fashion by means of the hooks engaging the respective pins.

5 Claims, 1 Drawing Sheet

STAIR TREAD SUPPORT

BACKGROUND OF THE INVENTION

1. Field of the Invention

The present invention relates to a stair tread support and more particularly to a stair tread support for a spiral staircase in which a plurality of stair treads are spaced spirally and extend outwardly from a central support column. Even more particularly, the invention relates to hook and bracket means adapted to support the stair treads on the column.

2. Description of the Prior Art

Spiral staircases are common and a very diverse number of means are used to support spirally located stair treads on a central column from which the treads extend. It is common to fabricate spiral staircases which include a vertically oriented tubular metal column or pole. These tubular metal columns are provided in some instances with special slots which are engaged by bosses or pins attached to the inner end of a stair tread. The pins when engaged in the slots support the stair tread on the column. For example, U.S. Pat. No. 4,587,780 shows such a stair tread support system. U.S. Pat. No. 485,449 shows another form of spiral staircase in which stair treads are supported by studs which extend through slots or openings formed in a tubular metal column. In both of these patents the stair tread is supported in cantilever fashion from the central support column.

Numerous other forms of spiral staircase supports are known in the prior art. For example, a stair tread may be supported mortise like by a cantilever arm which extends through a slot formed through a center support pole; the stair treads may be supported by providing the stair tread with an integral wooden ring at its inner end. This wooden ring is assembled over an elongated steel rod with wooden collars placed between the rings to space the treads from one another. Other constructions have been provided which include means for mounting a wooden tread on a steel arm having a steel ring at its inner end. This steel ring is a substitute for the wooden ring noted above.

It is particularly desirable from an aesthetic standpoint to fabricate a spiral staircase where the resulting construction only includes finished wood for all of the exposed surfaces. This, of course, is not possible in those constructions where the center column is formed of a length of tubular metal. Further, in those systems where wooden collars are used to space the stair treads from one another, a number of parts are involved in constructing the staircase which, of course, is disadvantageous from the standpoint that a large number of parts are necessary to construct the staircase at site location. Also, where a staircase is constructed from a large number of parts, it is inherently less strong and involves a substantially greater number of assembly steps, particularly in precision placing or adjusting of the individual stair treads. On the other hand, it is desirable to employ the strength of steel in stair construction where possible without sacrificing aesthetic considerations.

SUMMARY OF THE INVENTION

Accordingly, it is a main object of the present invention to provide a stair tread support for a spiral staircase in which the individual treads are supported in cantilever fashion from the central pole by means of a unique steel supporting bracket assembly in which the supporting brackets are concealed from view so that the staircase presents an all-wood appearance.

Additional objects involve the provision of a stair tread supporting system in which the strength of steel is utilized to support the stair tread, while at the same time giving the illusion that the staircase is constructed entirely from wood, the provision of a support which is easily assembled on site, in which the stair tread spacing is preset at the factory and in which a relatively small number of parts need to be assembled at the installation location.

In general, the staircase support system of the present invention includes the provision of a central wooden center column having a series of slots spirally located around the central column. Each of the slots has mounted therein a steel support bracket which consists of a base plate and a pair of support arms extending from the base plate. Each of the support arms includes a pair of support pins extending from opposite faces of the support arms. Each of the stair treads and risers are provided with a steel pin engaging hook assembly which is attached to the inner end of the tread riser assembly. The engaging member is provided with four downwardly disposed hook members, each of which engages one of the pins mounted on the support arms. The stair tread is assembled to the center column by inserting the four hook members into the slot to engage the pins and the hooks are urged downwardly toward the bottom of the stairs whereby the treads are held in place by friction engagement between the hooks and pins. The resulting assembly provide the strength of a steel cantilever support and eliminates inconvenient assembly procedures and requires no additional connection between the stair treads and the center post by fastening means.

BRIEF DESCRIPTION OF THE DRAWING

A preferred embodiment of the invention—illustrative of the best mode in which applicant has contemplated applying the principles—is set forth in the following description and shown in the drawing and are distinctly pointed out and set forth in the appended claims.

In the drawing.

Similar numerals refer to similar parts throughout the drawing.

DESCRIPTION OF THE PREFERRED EMBODIMENT

Figure 1:
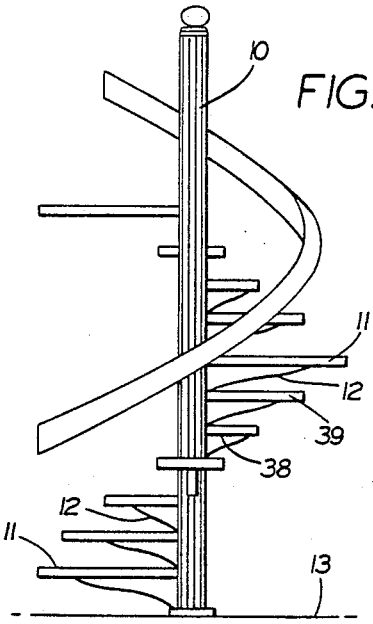
FIG. 1 is a diagrammatic illustration showing a staircase which has a plurality of treads mounted in spiral fashion around a central column, and on which the treads are supported by the support device of the present invention.

In FIG. 1, a spiral staircase is illustrated and includes a central vertical column 10 with a series of stair treads 11 and associated risers 12 spirally mounted on central column 10 and extending from floor surface 13 upwardly to a desired level. Each of the treads 11 and risers 12 is spaced above the preceding tread and riser 11 and 12 and are spirally located around central column 10.

In accordance with the present invention, a series of slots 15 are formed in central column 10, and each of the slots 15 is spirally arranged up column 10 and correspond to the location of each of the individual treads and risers 11 and 12. A receiver assembly or bracket 20 is located and mounted within slot 15. Each receiver 20 includes a base plate 21 which is elongated and provided with a series of apertures 22 to facilitate mounting base plate 21 to the central column 10 in slot 15 by means of screws 23. Each of the base plates 21 includes a pair of rectangularly shaped posts 24 which extend from base member 21 toward the opening of slot 15.

Posts 24 each include a pin 25 which extends through post 24 outwardly from opposing faces 24*a* of post 24. Thus, each post 24 is provided with a portion of pin 25 on each side thereof. Pin 25 may be formed of one piece which is mounted in opening 26 formed through post 24. Thus, each receiver member 20 includes two arms 24, each of which includes two pins 25. The resulting structure includes two pairs of pins 25, one for each arm 24.

Figure 3:
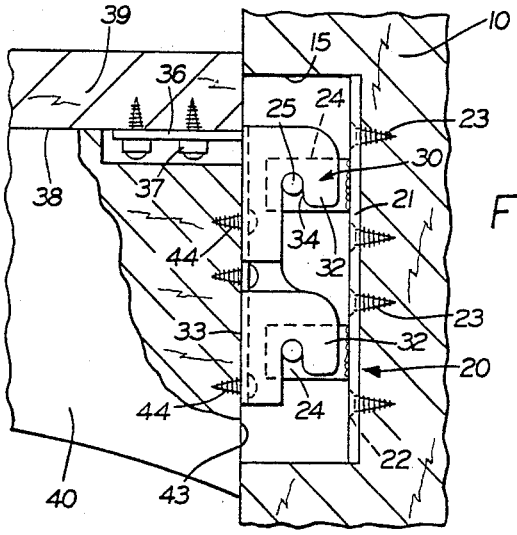
FIG. 3 is a fragmentary side elevation, partly in section, showing the supporting device mounted on a spiral staircase central column and supporting a stair tread and riser.
Figure 8:
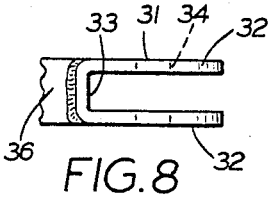
FIG. 8 is a fragmentary top elevation of the hook assembly shown in FIG. 6.
Figure 7:
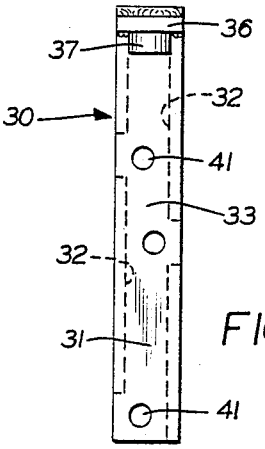
FIG. 7 is a front elevation of the hook assembly shown in FIG. 6.
Figure 6:
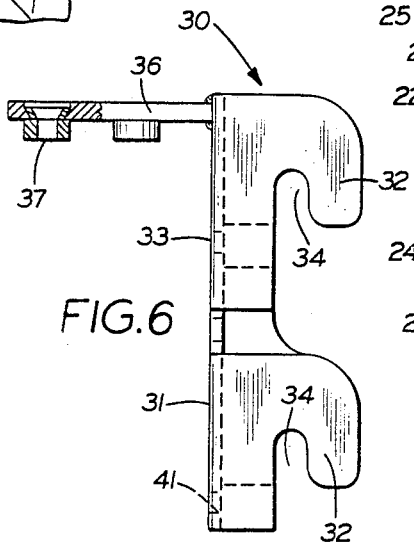
FIG. 6 is a side elevation of the hook assembly that is mounted on the stair tread and which engages the receiving bracket shown in FIG. 4.
Figure 5:
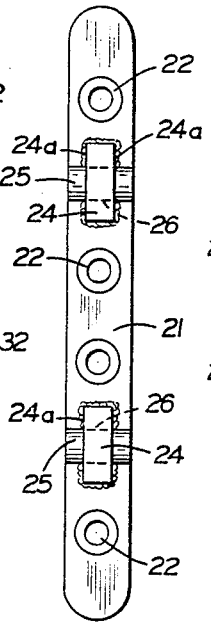
FIG. 5 is a front elevation of the receiving bracket illustrated in FIG. 4.

Receiver member 20 is, as seen in FIG. 3, located entirely within slot 15 formed in central post 10 and may be preassembled at a factory in the position shown in FIG. 3.

Figure 4:
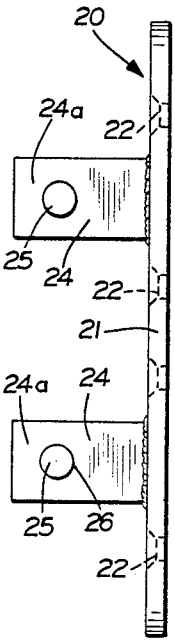
FIG. 4 is a side elevation of the receiving bracket that is mounted on the central column.

Hook member 30 is illustrated in the left-hand portion of FIG. 4 and includes a channel shaped member 31 having four hook arms 32 projecting outwardly from hook base portion 33. With respect to vertical orientation, hook portions 32 project downwardly so that hook arms 32 and their hook openings 34 face downwardly from the top. An anchor strap 36 is attached to the top of channel 31 and is provided with a plurality of openings 37 which may be attached to the bottom surface 38 of a stair tread 39 as seen in FIG. 3. Anchor strap 36 may be concealed after assembly by locating it within stair riser 40. Additionally, hook member 30 may be provided with a series of openings 41 which extend through base 33 to provide a means of attaching the hook member to the vertical surface 43 of riser 40 by means of suitable screws 44.

Anchor strap 36 and support arms 24 may be respectively attached to channel 31 and base 21, all of which are formed of a suitable steel, by welding. In assembled position, but prior to mounting a stair tread on a central post, receiver member 20 will be mounted in each of its respective slots spirally on the length of a central column 10 which is preferably formed from a desired wood material. Each of the treads 39 which is to be mounted on central post 10 will have a hook assembly mounted on the inner end of the tread and riser, that inner end comprising that end located adjacent to central post 10.

To assemble a stair tread and riser to the central post, hook member 30 is inserted within slot 15 and moved with hook openings 34 slipping over and engaging in a friction-fit manner each of the four pins 25 of support arm 24. In assembled position, stair tread 11, riser 12, central column 10 and supporting bracket system of the present invention are illustrated in FIG. 3.

As seen in FIG. 3, the entire bracket support system is, in final assembled position, located within slots formed in the center support post and the tread riser. The external appearance, therefore, that is visible to an observer is only the material from which the tread, riser and center post is fabricated. In the preferred embodiment these components will be manufactured from wood. Accordingly, a staircase embodying the supporting device of the present invention will appear to be made entirely from wood, yet the concealed support affords the construction the strength of steel.

Other advantages are obtained from the present invention. The center post may be preassembled at a factory by forming a series of slots in the post and premounting a receiving bracket in each slot. Individual treads and risers may be preassembled with hook members. These subassemblies may then be shipped to an erection site. The center post is then located in proper position to receive the stair treads. The individual treads are then mounted on the center post by press fitting the hook members on the pins after inserting the hook members in each of the preformed slots. Additional components such as a hand railing and balusters may then be attached to complete the staircase.

Figure 2:
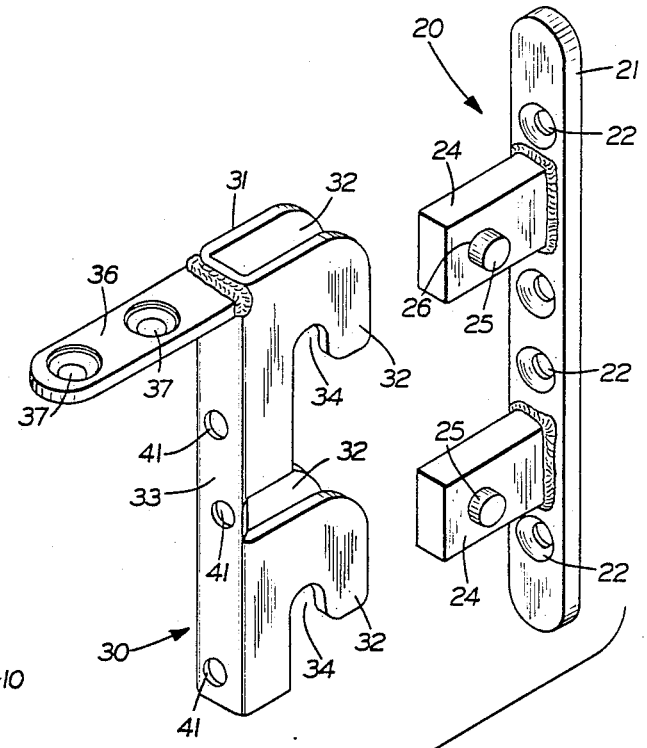
FIG. 2 is a perspective view of the two members which comprise the stair tread support system of the present invention.

An important advantage of the present invention is the provision of a staircase construction which aesthetically appears to be constructed from wood but which incorporates a steel tread support to provide exceptional strength. Additionally, the staircase does not require the assembly of a large number of components at the construction location. Further, the construction is achieved by employing readily available materials formed at reasonable cost. For example, the steel components can be easily fabricated from stampings and welded or staked together to form the subcomponents shown in FIG. 2. Finally, the assembled staircase utilizes a friction fit between the hook member and receiving bracket to provide a strong, stable and attractive unit.

In the foregoing description, certain terms have been used for brevity, clearness and understanding but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved stair tread support is constructed, assembled and operated, the characteristics of the new construction, and the advantageous, new and useful results obtained; the new and useful structures, devices, elements, arrangements, parts, and combinations are set forth in the appended claims.

I claim:

1. Stair tread support construction for a spiral staircase including an elongated hook receiving member adapted to be mounted on the center post of a spiral staircase, a pair of arms extending from the hook receiving member, each of said arms including a pair of pin means adapted to be engaged by hook means, means for attaching said hook receiving member to the center post of a spiral staircase, channel shaped hook engaging means including a base portion and a pair of channel arms extending from the base, said hook engaging means including means for attaching said channel base to the riser of a spiral staircase, each of said channel arms including a pair of downwardly opening hook members adapted to engage the pins with the hook receiving member, and means for attaching the hook engaging member to a stair tread of a spiral staircase.

2. Stair tread support construction as defined in claim 1 in which said hook receiving member and said hook engaging member are formed of steel.

3. Spiral staircase construction including a center post, a plurality of elongated slots formed in said center post and spirally located around said center post, hook receiving means mounted in said slots, said hook receiving means including a base member and a pair of pin support arms extending from said base member, each of said pin support arms including a pair of pin means, a plurality of stair tread and riser means, said stair tread means having hook engaging means mounted thereon, said hook engaging means being channel shaped and including a base and a pair of hook arms extending from the base, said hook engaging member hook arms frictionally engaging the pins of the hook receiving means, and means for attaching the hook receiving member and hook engaging means respectively to the center post and stair tread and riser.

4. Spiral staircase construction as defined in claim 3 in which said hook receiving means and said hook engaging means are formed of steel.

5. Spiral staircase construction as defined in claim 3 in which said hook arms and said hook receiving means are disposed entirely within said center post slots.

* * * * *